US005862700A

United States Patent [19]

Klein

[11] Patent Number: 5,862,700

[45] Date of Patent: Jan. 26, 1999

[54] METHOD AND APPARATUS FOR FORMING A PROFILE IN A WALL OF A HOLLOW CYLINDRICAL WORK PIECE

[75] Inventor: Erwin Klein, Rodgau, Germany

[73] Assignee: Herzing + Schroth GmbH & Co. KG, Obertshausen, Germany

[21] Appl. No.: 924,586

[22] Filed: Sep. 19, 1997

[30] Foreign Application Priority Data

Sep. 24, 1996 [DE] Germany ..... 196 39 081.8

[51] Int. Cl.[6] ..... B21D 9/08; B21B 17/10

[52] U.S. Cl. ..... 172/213; 72/208

[58] Field of Search ..... 72/213, 207, 208, 72/212, 178, 242, 133

[56] References Cited

U.S. PATENT DOCUMENTS 5,709,118 1/1998 Ohkubo ..... 72/213

FOREIGN PATENT DOCUMENTS 2554743 5/1985 France ..... 72/208

2017709 11/1971 Germany .

2829041 1/1980 Germany .

*Primary Examiner*—Joseph J. Hail, III

*Assistant Examiner*—Rodney Butler

*Attorney, Agent, or Firm*—W. F. Fasse; W. G. Fasse

[57] ABSTRACT

Hollow cylindrical blanks of tubular stock are transformed into finished work pieces (3) in a single work stroke with a profiling tool (7) equipped with profiling rollers (30) in one tool section (8) and a die matrix (15) in another tool section (6). The two tool sections (6, 8) are coaxially movable relative to each other, for example by a press. Each profiling roller in the one tool section is rotatably mounted in a chamber and all rollers (30) are positioned circularly around a central longitudinal tool axis (34) so that a central plane of each roller extends substantially radially relative to the tool axis. The die matrix (15) in the other tool section (6) is supported on a central mandrel or arbor (14) that also supports the blank. The die matrix (15) has in its outer surface a plurality of grooves (15A) and ridges (15B) that cooperate with grooves and ridges in the profiling rollers.

16 Claims, 5 Drawing Sheets

METHOD AND APPARATUS FOR FORMING A PROFILE IN A WALL OF A HOLLOW CYLINDRICAL WORK PIECE

FIELD OF THE INVENTION

The invention relates to profiling the wall of a hollow cylindrical blank to form a work piece with tongues and grooves alternating with one another around the circumference of the work piece. The tongues form gear teeth and the grooves form valleys between the gear teeth. The tongues may reach radially inwardly and/or radially outwardly from the original outer diameter of the blank. Such a work piece may function as a component in gear transmission or as a mechanical transmitter of a sensor signal, for example.

BACKGROUND INFORMATION

The profiling of a blank, for example in the form of a pot-shaped blank, into a work piece is accomplished by holding the blank on an arbor or support having a profile along its outer surface corresponding to the tongues and grooves to be formed in the wall of the blank. The profile of the support or holding arbor cooperates with profiling rollers arranged concentrically, whereby the work piece and the profile rollers are movable in parallel to the longitudinal axis of the tool as well as relative to each other. Such an apparatus and a method for the formation of the tongues and grooves is disclosed in German Patent Publication DE-A1 2,829,041 (Mehler et al.) published on Jan. 10, 1980. The blank used conventionally is a sheet metal member, whereby the arbor carrying the blank is pressed through a profiling roller arrangement which rolls along the blank in parallel to the central longitudinal axis of the tool.

The profiling roller arrangement comprises a plurality of profiling roller sets that are arranged concentrically around the central longitudinal axis of the tool. These roller sets can be arranged either next to each other or axially above each other. When the rollers are arranged next to each other a so-called transfer press is used as a drive for the support arbor which carries the blank while simultaneously supporting the profiling roller arrangement. In the second case in which a plurality of concentrically arranged profiling rollers are positioned axially above one another, a simple press with its upper and lower press die sections forms a driving unit.

German Patent Publication DE-OS 2,017,709 (Propach et al.) published on Nov. 4, 1971 discloses a tool for forming longitudinal grooves in a cylindrical work piece, wherein the profiling rollers are mounted for adjustment in the direction of a force exerted by the rollers. Two support rollers contacting one profiling roller at the roller circumference are provided for each profiling roller. The support rollers are rotatably mounted in a bearing block and cannot be displaced. The support rollers take up the forces which are effective on the profiling rollers. Such a structure is intended to relieve the profiling rollers as much as possible from the deformation forces so that the mounting and thus the profile rollers themselves can be dimensioned smaller than would be necessary otherwise.

With the apparatus according to German Patent Publication DE-A1 2,829,041 it is possible to produce the cylindrical work pieces with a radially outwardly and a radially inwardly facing gear teeth configuration and such production can proceed substantially in a fully automatic manner with the required large precision. However, the known apparatus is feasible from an economic point of view only if large production numbers are to be produced.

The use of a method or an apparatus for the above described profiling operation is controlled by the question whether such use is economically feasible so that a certain method or apparatus is used only when the costs per piece produced are advantageous. This requirement could not be met by the apparatus disclosed in the first mentioned German Patent Publication when small production numbers were involved.

OBJECTS OF THE INVENTION

In view of the above it is the aim of the invention to achieve the following objects singly or in combination:

- to construct an apparatus for the production of the above described work pieces in such a way that it is economically suitable for the production of large work piece numbers as well as for small numbers;
- to produce corrugated work pieces from hollow cylindrical blanks so that the work pieces have an inner and/or outer gear configuration in the finished work piece wall, whereby the costs of making and operating the tool must be suitable for producing even small numbers of any particular work piece size;

to construct the components of the tool in such a way that the exchange of only a few components will permit working work piece blanks of different dimensions; and

- to provide a profiling method which permits converting hollow cylindrical blanks into finished work pieces with a single profiling stroke by a tool with a single set of profiling rollers.

SUMMARY OF THE INVENTION

The tool according to the invention has a first tool section for holding a blank and a second tool section for profiling the blank into a work piece in a single work stroke. The first and second tool sections are movable relative to each other in the manner of a die press. The profiling tool section carries a profiling tool (7) including a plurality of profiling rollers, preferably forming a single set of profiling rollers, each of which is rotatably mounted in a radially inwardly open chamber and each chamber is formed by mounting blocks having walls forming a U-shaped cross-sectional configuration. The chambers holding the profiling rollers are arranged concentrically around a central longitudinal tool axis. The first blank holding tool section has at least one die matrix (15) with the required profile in its circumference for cooperation with the profiling rollers of the second tool section for deforming the blank into the finished work piece.

The method of the invention is characterized by the following steps:

(a) providing each profiling roller of a set of profiling rollers with a circumferential profile so that each circumferential profile has the same rated finishing dimension, (b) dimensioning said profiled die matrix (15) to a respective rated finishing dimension, (c) placing said hollow cylindrical work piece on said profiled die matrix, and (d) moving at least one of said die matrix and said set of profiling rollers axially relative to each other for finishing said work piece in a single work stroke along its length to be profiled.

It is an advantage of the invention that individual components such as rollers or the tool holder with its profiled matrix are easily exchanged by identical other components for maintenance work or by differently dimensioned components for shaping blanks of different sizes.

Due to the fact that the mounting blocks for the profiling rollers have a U-cross-sectional configuration it is possible to provide a profile roller tool (7) that is simple in its structure and has simple components which are easily variable by exchanging components to provide excellent operational results. Another advantage of the present tool is seen in that a blank can be finished into a work piece with the required precision in a single work stroke so that repeated work strokes for achieving the required precision are not necessary for the formation of the gear teeth or profile in the wall of the hollow blank.

It is practical to make the first tool section a lower tool or die section and the second tool section an upper tool or die section. These lower and upper tool sections are constructed for cooperation with a simple conventional die press or with a so-called transfer press in which several press stations are arranged horizontally next to one another. In both instances a complete gear teeth formation or profiling is achieved with a single work stroke so that a work piece is finished with each stroke.

It is especially practical to perform the deformation or rather profiling of the blank into the work piece in such a manner that the given initial wall thickness of the cylindrical blank is not reduced or only slightly reduced in the range of the root circle of the finished profiling while a substantial wall thickness reduction takes place along flanks of the profile. Simultaneously, the wall thickness reduction along the crown circle of profile is minimal or slight. These relative wall thickness reductions in the three areas namely along the root circle (66), along the crown circle (67) and along the profile flanks (68) have reference to the original wall thickness of the cylindrical blank. For example, a wall thickness reduction up to 10% of the original wall thickness is considered slight or minimal while a reduction up to 50% is considered substantial. The production of a work piece with inner and outer gear teeth in its cylindrical wall can be accomplished in a single work stroke especially if the above mentioned wall thickness conditions are maintained.

An apparatus for performing the present method can be manufactured economically, especially if the profiling rollers (30) of the profiling tool (7) are arranged symmetrically relative to a separation plane or plane of symmetry (38) that extends through all rotational axes (31) of the profiling rollers. Such a structure requires but few different parts and most parts are identical to each other such as the rollers, their rotational axles and the U-section mounting blocks (32, 33) that form the roller chambers (37) in a housing holding all chambers. For example, all chamber forming mounting blocks are readily exchangeable against one another. Thus, maintenance and repair work is facilitated and different size work pieces are readily accommodated by keeping a few exchangeable parts in stock.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
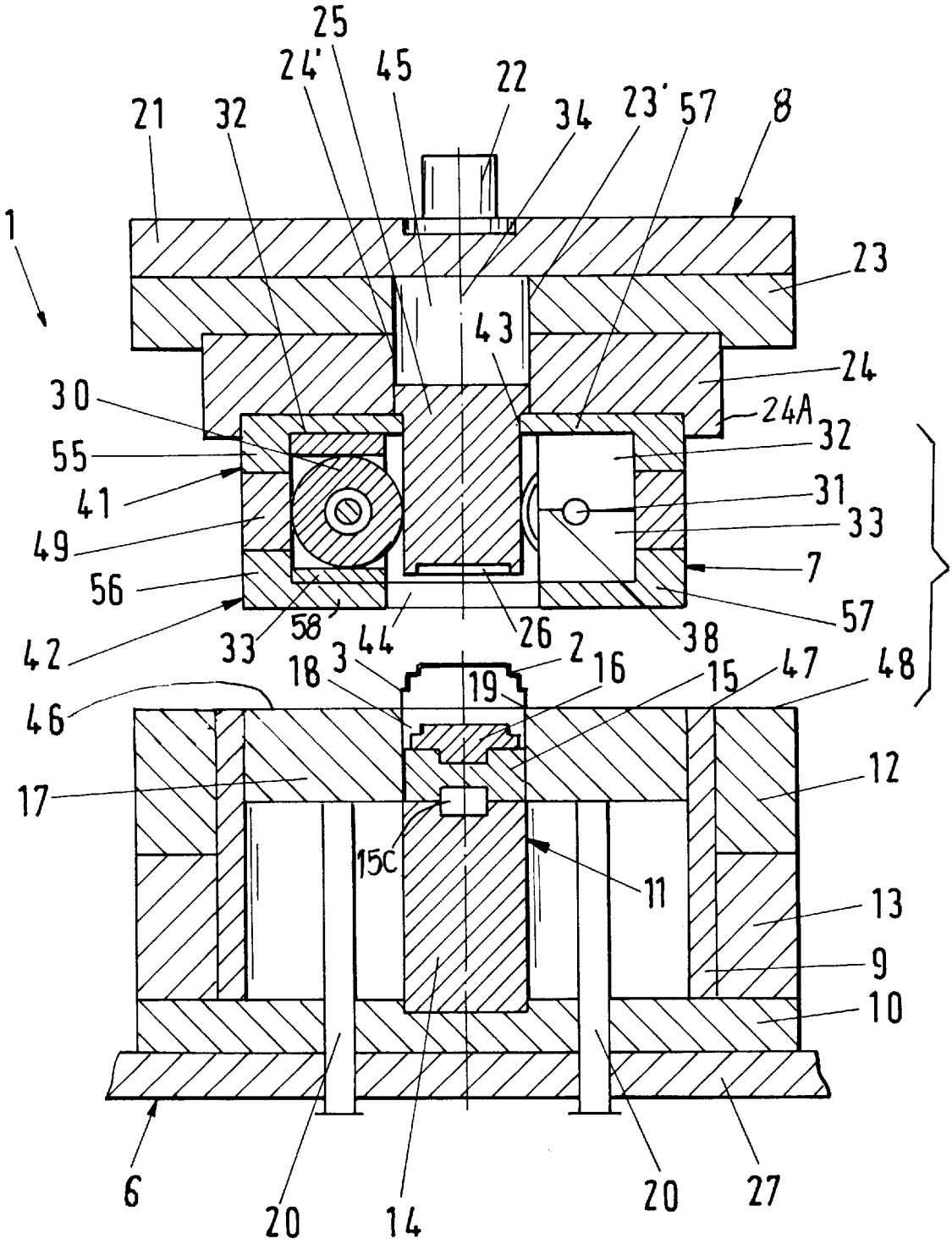
FIG. 1 shows an axial longitudinal section through the present tool in its open state, wherein the upper tool section is withdrawn from the lower tool section.
Figure 2:
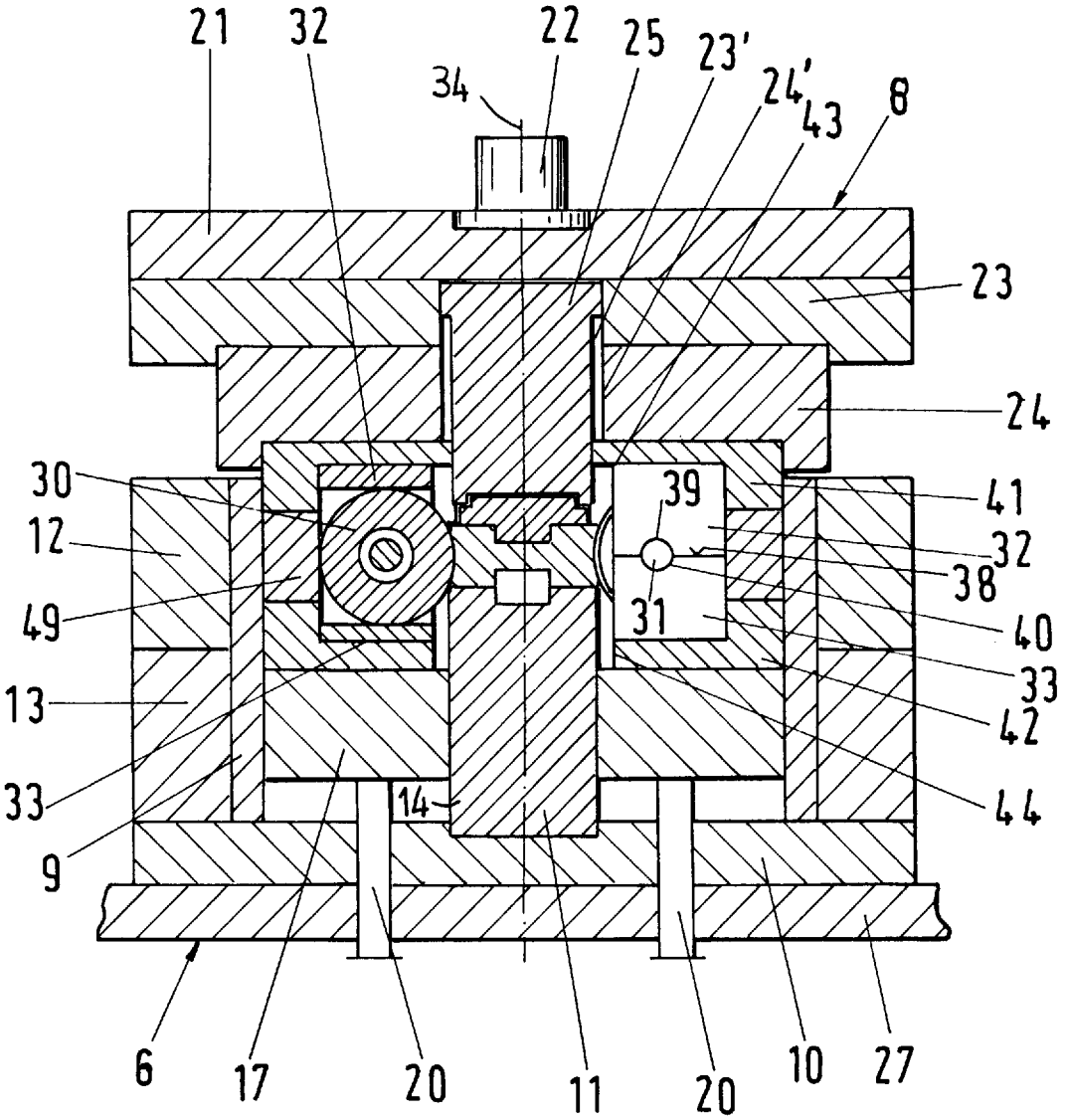
FIG. 2 is a sectional view similar to that of FIG. 1 along section line II—II in FIG. 3 and showing the tool in its substantially closed position when a work piece is finished.

Referring to FIGS. 1 and 2 in conjunction, a grooving tool 1 according to the invention for profiling a blank into a work piece 2, comprises a first tool section 6 also referred to as a lower tool section and a second tool section 8 also referred to as an upper tool section. The upper tool section comprises a profiling tool 7. It is not necessary that the tool sections 6 and 8 are arranged vertically above each other. The tool sections may alternatively be arranged horizontally. In both instances the tool sections are axially aligned with each other relative to a common central longitudinal axis 34.

Figure 5:
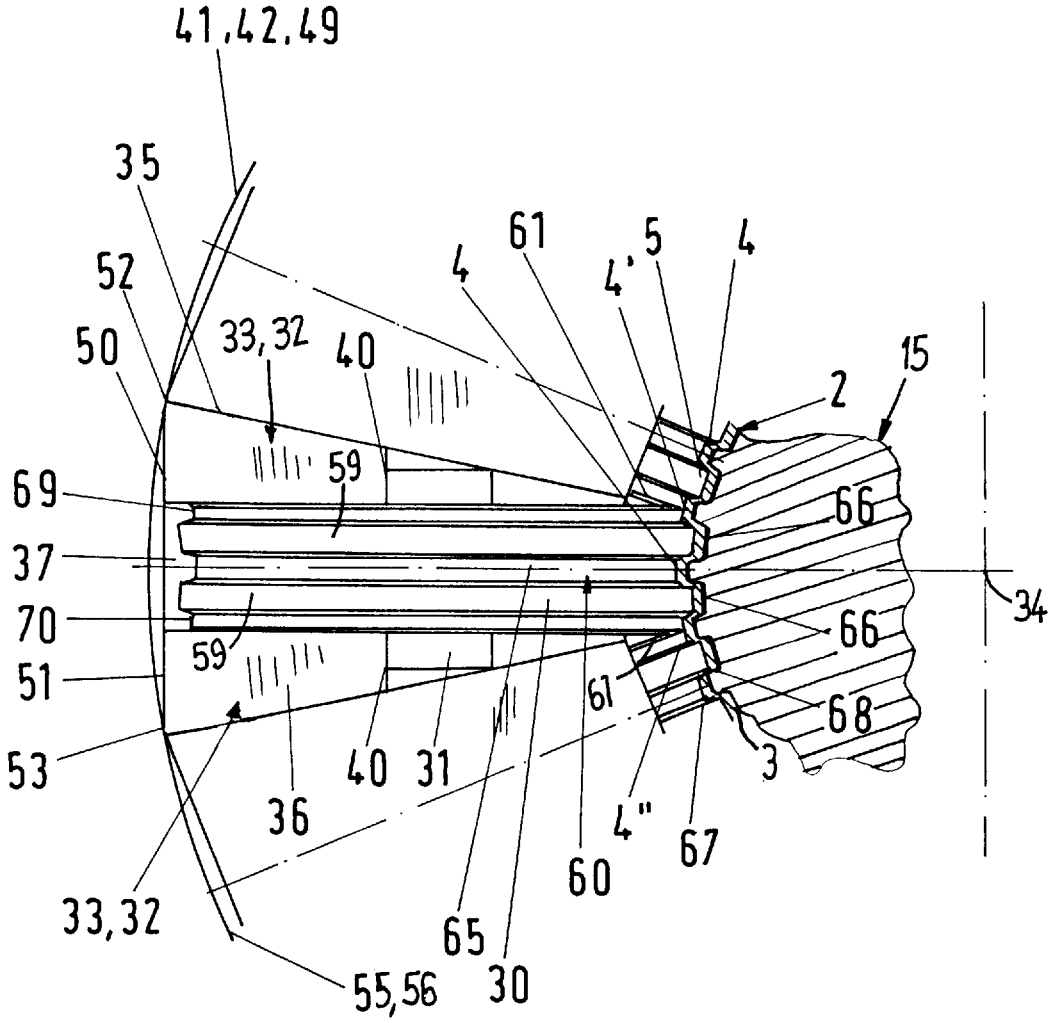
FIG. 5 is a sectional view along section line V—V in FIG. 4 to illustrate the cooperation of a profiling roller (30) with die matrix (15).

Referring to FIG. 5, the present tool deforms or profiles a wall 3 of the hollow cylindrical work piece 2. Such profiling provides the wall (3) with a tongue and groove configuration in which the tongues 4 and the grooves 5 extend in parallel to each other and in parallel to the longitudinal axis 34 of the tool. The tongues 4 are also referred to as gear teeth which together with the grooves 5 are formed simultaneously all around the work piece 2 in a single work stroke as will be described in more detail below.

For achieving the above single stroke finishing, the first or lower tool section 6 comprises a base plate 10 which is mounted on a press plate 27 which is connected to or part of a table or lower die of a conventional press, further details of which are not shown. The base plate 10 supports a guide bushing 9 concentrically relative to the central longitudinal axis 34. Load take-up rings 12 and 13 surround the guide bushing 9. The ring 13 rests on the base plate 10. The ring 12 rests on the ring 13. The lower tool 6 further comprises a centrally positioned support arbor 11 as best seen in FIGS. 1 and 2. The arbor includes a carrier member 14 supporting a die matrix or grooving member 15 which in turn holds a work piece support member 16. An ejector 17 concentrically surrounds the arbor 11 and is movable, for example hydraulically axially up and down guided by guide columns 20. The ejector plate 17 has a central bore 18 having a diameter slightly smaller than the outer diameter of the free rim 19 of the work piece 2. Thus, the work piece 2 can initially rest on the upwardly facing top surface 46 of the ejector 17. The ejector 17 is lowered until the work piece 2 rests with its inwardly facing bottom surface on the work piece support member 16 of the arbor 11. Once the work piece 2 rests on the arbor 11, or rather on the member 16 of the arbor 11, the ejector 17 is further lowered into the position shown in FIG. 2.

As best seen in FIG. 2, the second or upper tool section 8 comprises the profiling tool 7 exchangeably mounted to a pressure application ring 24 having a centering rim 24A. The pressure application ring 24 in turn is mounted to an intermediate plate 23 that mounts the plate 24 to a further pressure plate 21 which in turn is connectable through a stud 22 to an upper pressure application section of a press not shown. The mounting ring 23 and the pressure ring 24 have axially aligned respective bores 23' and 24' in which a down holder 25 is slideably received. The down holder 25 is axially aligned with the arbor 11 and has a downwardly facing recess 26 that forms a shoulder for encircling a respective shoulder in the bottom of the work piece 2 as shown in FIG. 2 when a relative movement between the lower and upper tool sections 6 and 8 is performed in a work stroke as will be described in more detail below.

The profiling tool 7 that is secured to the upper tool section 8 comprises a roller housing formed by an upper housing ring 41, a lower housing ring 42, and an intermediate housing ring 49 between the upper and lower rings 41 and 42. All three rings are axially aligned with each other. The upper ring 41 has a downwardly facing rim 55. The lower ring 42 has an upwardly facing rim 56. The upper ring 41 is surrounded by the shoulder 24A of the pressure application ring 24. The rims 55 and 56 rest against the intermediate ring 44.

A plurality of roller chambers 37 are formed in the roller housing by wedge-shaped roller mounting blocks 32 and 33 best seen in FIG. 5. Each roller 30 is mounted in its chamber 37 on a bearing axle 31 which is held in place by the upper and lower mounting blocks 32 and 33 contacting each other along a separation plane 38 which is preferably also a plane of symmetry in which the rotational axis of the mounting axles 31 are located. For this purpose the upwardly facing surface of the block 33 and the downwardly facing surface of the block 32 have respective semicircular grooves for holding the roller axles 31.

Figure 4:
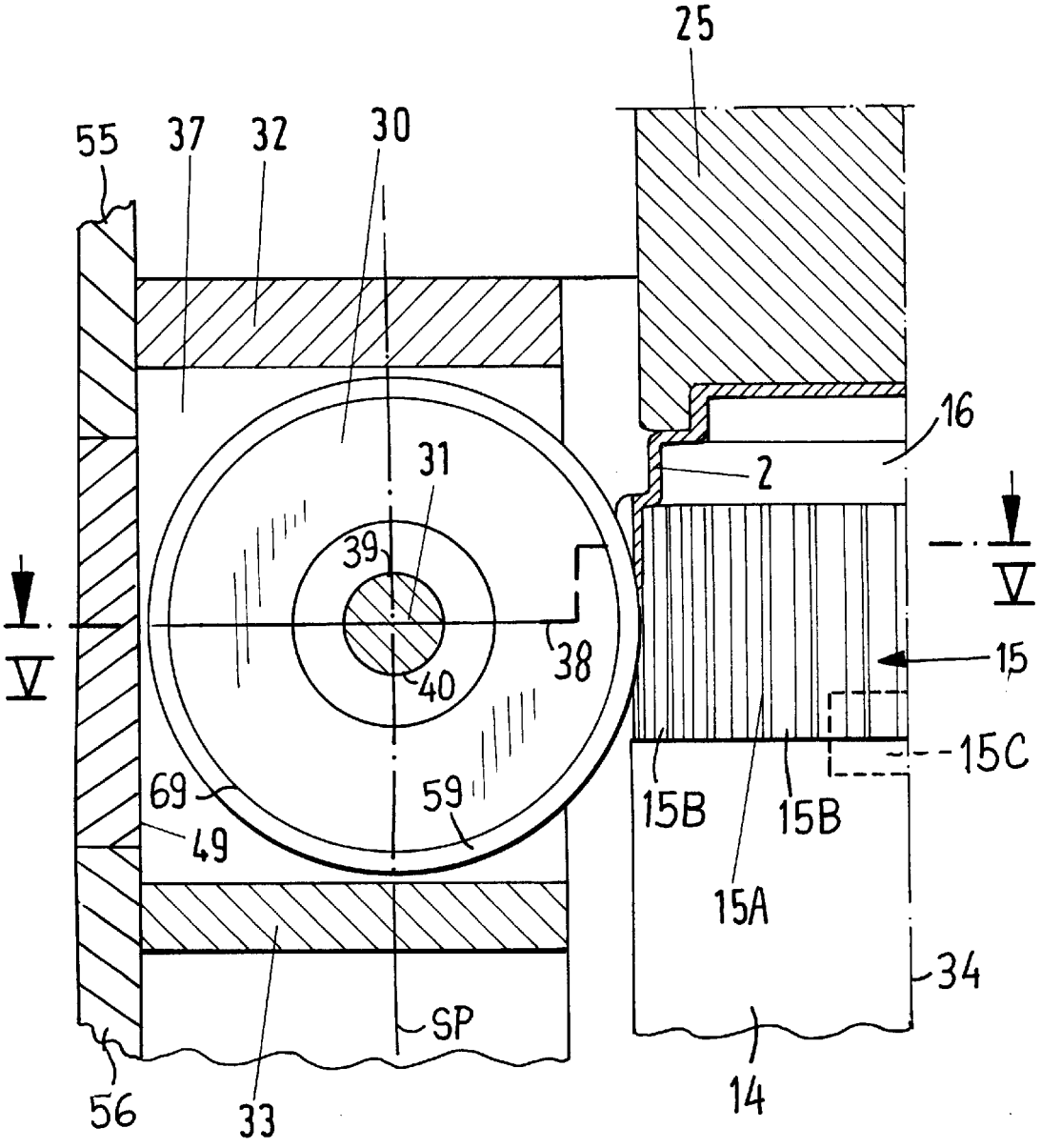
FIG. 4 shows, on an enlarged scale compared to FIG. 2, the detail of the cooperation of one of the profiling rollers with the die matrix or grooving section of the lower tool.

Referring to FIGS. 4 and 5 in conjunction, the mounting blocks 32 and 33 of the invention have a U-shaped configuration as viewed toward a section plane SP shown in FIG. 5 that extends in parallel to the central longitudinal axis 34. Thus, the open end of the U-configuration of the block 32 faces downwardly while the open end of the U-configuration of the block 33 faces upwardly so that the downwardly facing lateral wall sections of the block 32 rest on the upwardly facing lateral wall sections of the block 33, thereby enclosing the roller chamber 37 which is open in the radial direction toward the central axis 34 and closed circumferentially by the ring 49 and the axially extending rims 55 and 56.

As shown in FIG. 5, the lateral walls 35 and 36 of the mounting blocks 32 and 33 are slanted so that these lateral walls 35, 36 form a wedge-shape, whereby the lateral walls 35 and 36 are oriented substantially radially relative to the central axis 34. The walls of the blocks 32, 33 opposite the slanted walls extend in parallel to each other as best seen in FIG. 5. The mounting axles 31 of the rollers 30 are so positioned that a portion of the rollers extends out of the open end of the chamber 37 radially inwardly for cooperation with the profiling surface of the die matrix 15 resting on the support 14 of the arbor 11. The profiling surface has grooves 15A alternating with ridges 15B extending in parallel with each other and in parallel with the central axis 34. These grooves 15A and ridges 15B cooperate with the rollers 30 in the profiling of the work piece 2 as will be described in more detail below.

The above-mentioned plane 38 of symmetry extends radially to the central axis 34 and through the semicircular grooves 39 and 40 of the mounting blocks 32 and 34 for the mounting axles 31 of the roller 30. These grooves 39, 40 face each other across the plane of symmetry 38 so that the mounting axles 31 are bisected by the plane of symmetry 38 as best seen in FIGS. 1, 2 and 4. A plug 15C inserted centrally in a recess of the support 14 reaches into a recess of the die matrix 15 to restrain the latter against horizontal displacement. This feature permits an easy exchange of one grooving section against another grooving section. Similarly, the work piece support member 16 reaches with an axially downwardly facing projection into a respective recess of the die section 15 for the same purpose of lateral restraint.

Referring further to FIGS. 1 and 2, the mounting blocks 32 and 33 with their respective profiling roller 30 are held in place by the upper housing ring 41 and by the lower housing ring 42 which axially face the rims 55 and 56 of the housing ring 49 which acts as a load take-up ring. The upper ring 41 has a central bore 43 that surrounds the hold-down member 25. The lower ring 42 has a central bore 44 that permits the support 14 with the sections 15 and 16 to move into the profiling tool 7 so that the hold-down member 25 can press the work piece 2 against the work piece support 16 when the two tool sections are moved toward each other as shown in FIG. 2. In a profiling stroke the hold-down member 25 moves upwardly in the space 45 until it contacts the downwardly facing surface of the plate 21 as seen in FIGS. 1 and 2.

The profiling begins when the profiling rollers 30 start engaging the cylindrical wall 3 of the work piece 2. The profiling operation ends when the rollers reach the lower edge of the work piece as shown in FIG. 2. In this position the ejector 17 has also reached its lower position as shown in FIG. 2. Upon completion of the single profiling stroke according to the invention, the upper tool section 8 is pulled up away from the lower tool section 6, whereby the ejector 17 lifts the work piece 2 off the work piece holding member 16 back into the position shown in FIG. 1 where the upwardly facing surface 46 of the ejector 17 is in the same plane with the upwardly facing surface 47 of the guide bushing 9 and the upwardly facing surface 48 of the ring 12. Now the finished work piece 2 can be removed from the work piece support member 16, for example manually, and replaced by a cylindrical blank for the next stroke.

Forces occurring during the profiling operation as just described are primarily radial forces, which are transmitted through the mounting or bearing blocks 32 and 33 onto the housing rings 41 and 42 and the load take-up ring 49 which encircle the mounting blocks 32 and 33.

Figure 3:
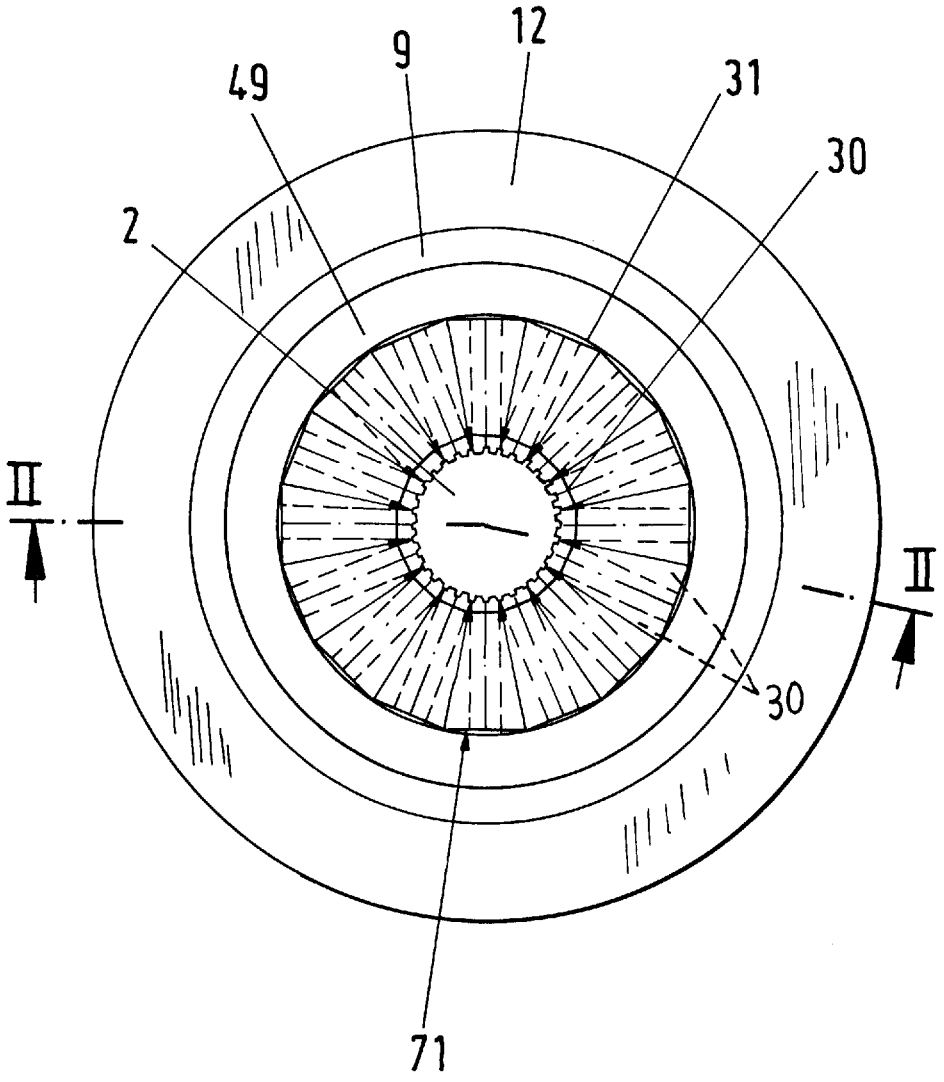
FIG. 3 is a view in the direction of the central longitudinal axis of the present tool with parts above the viewing plane removed, whereby the viewing plane coincides with the upwardly facing surface of an outer load take-up ring of the lower tool section.

As shown in FIGS. 3 and 5 the mounting blocks 32 and 33 rest with their slanting surfaces 35 and 36 against neighboring mounting blocks, thereby supporting one another in the circumferential direction. Additionally, the mounting blocks 32 and 33 rest in the axial direction against the axial rims 55 and 56 and against the ring 49 along contact lines 52 and 53 forming corners of the wide ends 50 and 51 of the mounting blocks 32 and 33. In another embodiment, the radially outwardly facing surfaces of the wide ends 50 and 51 of the blocks 32 and 33 may have the shape of a cylindrical segment so that the respective segment surfaces rest entirely against the radially inwardly facing surface of the ring 49 and of the axial rims 55 and 56. In this connection, it should be noted that the housing rings 41 and 42 contribute significantly to taking up the forces that occur during a grooving operation. Thus, the rims 55 and 56 and the radially extending flat ring portions 57 and 58 of the housing rings 41 and 42 are dimensioned for this purpose.

FIGS. 1 and 2 further show that the individual components of the profiling tool 7 are preferably shaped mirror-symmetrically to each other relative to the plane of symmetry 38. Additionally, most components are identical in their configuration. For example, any of the mounting blocks 32, 33 is suitable to house any of the rollers 30. Further, if the bores 43 and 44 have identical diameters, the housing rings 41 and 42 are readily exchangeable. Another advantage of the invention is seen that the profiling rollers 30 are substantially completely enclosed on all sides except for the bore 44, whereby contamination of the rollers 30 is substantially avoided. The enclosure of the rollers 30 upwardly is complete and only the bore 44 opens the tool 7 downwardly to a minimal extent, whereby the rollers 30 are well protected.

Not only when the tools are closed as shown in FIG. 2, but also when they are open as shown in FIG. 1.

Referring to FIGS. 3 and 5, the profiling rollers 30 are arranged radially and concentrically around the central axis 34. Each roller has a circumferential profile 60 with two circumferential, radially outwardly projecting rims 59 axially spaced from each other by a groove 65. One half groove 69 or 70 is provided on one side of each rim 59. These half grooves 69 and 70 are so configured and dimensioned that full grooves are formed on the radially inner roller side along contact surfaces 61 between neighboring rims 59 of two neighboring rollers 30. These contact surfaces 61 are positioned in an axial plane extending radially through the interface between two neighboring mounting block surfaces 35 and 36 toward the longitudinal central axis 34. These grooves 69, 70 in cooperation with ridges 15B of the die matrix 15 cut teeth 4' and 4" in the initially cylindrical surface 3 of the work piece 2 as seen in FIGS. 4 and 5. The teeth 4 are formed by the groove 65 in cooperation with the ridges 15B when the profiling tool 7 rolls axially along the work piece surface as seen in FIG. 4.

The initial blank for forming the present work pieces 2 is a cylindrical sheet metal member in which the cylindrical wall 3 has a defined uniform wall thickness. The outer diameter of the finished work piece 2 is the diameter of the tip or crown circle 67 of the gear teeth formed in the work piece. The inner diameter of the finished work piece is the diameter of the root circle 66 of the gear teeth formed in the work piece. The respective crowns and roots of the gear teeth are connected by flanks 68 of the gear teeth. As the deformation or profiling proceeds when the two tool sections move axially relative to each other the wall thickness along the root circle 66 are not made thinner than the original uniform wall thickness of the blank or are made thinner only slightly compared to the substantial wall thickness reduction along the teeth flanks 68. Further, the teeth crowns are only slightly made thinner than the original wall thickness by the profiling operation as shown in FIG. 5. The teeth flanks 68 are thus correspondingly thin-walled and form substantially radially oriented lands between the respective teeth roots and the radially outwardly positioned teeth crowns.

Each of the profiling rollers 30 forms a tooth 4 with the groove 65 positioned between the rims 59 while the half grooves 69 and 70 in cooperation with half grooves of neighboring rollers 30 form the teeth 4' and 4".

The profiling tool 7 according to the invention is a compact unit which requires but one set 71 of profiling rollers arranged as a ring around the central axis 34 for finishing a work piece of a given size in a single work stroke. Other sets of rollers with different dimensions can be used for finishing in one stroke work pieces having different diameters. All tool components are held together by nuts and bolts not shown.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for forming a profile in a wall of a hollow cylindrical work piece, comprising a central longitudinal tool axis (34), a first tool section (6), a profiled die matrix (14, 15, 16) operatively mounted in said first tool section (6), a second tool section (8), and a profiling tool (7) operatively mounted to said second tool section (8), said die matrix (15) comprising a profiling surface (15A, 15B) for cooperation with said profiling tool (7), a plurality of mounting blocks (32, 33) each having a U-cross-sectional configuration, said mounting blocks forming a number of mounting chambers (37) open radially inwardly relative to said tool axis (34), and a number of profiling rollers (30) rotatably mounted in said mounting chambers (37) for cooperation with said profiling surface (15A, 15B) of said die matrix (15) when said first and second tool sections (6, 8) are moved coaxially relative to each other.

2. The apparatus of claim 1, wherein said number of mounting chambers (37) and said number of profiling rollers (30) are equal to each other so that one profiling roller is mounted in each mounting chamber and so that each roller projects radially inwardly out of its mounting chamber for said cooperation with said profiling surface (15A, 15B) of said die matrix (15).

3. The apparatus of claim 1, wherein said mounting blocks (32, 33) are arranged in pairs, so that two mounting blocks form one of said mounting chambers (37).

4. The tool of claim 1, wherein each mounting block (32, 33) comprises side walls forming legs of said U-cross-sectional configuration, said side walls having a wedge-shape so that at least one side wall surface of said mounting blocks extends substantially radially to said central longitudinal tool axis (34).

5. The apparatus of claim 1, further comprising a load take-up ring (49) positioned around said mounting blocks (32, 33), said tool further comprising a first housing ring (41) and a second housing ring (42), said mounting blocks (32, 33) and said load take-up ring (49) being positioned between said housing rings (41, 42) so that said rings (41, 42, 49) enclose said mounting blocks.

6. The apparatus of claim 1, wherein each of said profiling rollers (30) comprises an identical rated finishing dimension so that a single set of identical profiling rollers is constructed for finishing a work piece in a single profiling stroke.

7. The apparatus of claim 1, wherein said mounting blocks (32, 33) comprise semicircular recesses (39, 40), said profiling rollers comprising rotation axles (31) mounted in said semicircular recesses (39, 40) between two mounting blocks (32, 33) forming a pair.

8. The apparatus of claim 1, wherein said first tool section (6) is a lower tool section (6), said die matrix (15) forming a part of said lower section, wherein said second tool section (8) is an upper tool section, said profiling tool (7) forming a part of said upper tool section (8), and wherein said profiling rollers (30) in said mounting chambers (37) of said profiling tool (7) are part of said upper tool section (8).

9. The apparatus of claim 1, wherein said mounting blocks (32, 33) of said profiling tool (7) are all identical to each other so that said identical mounting blocks (32, 33) can form upper or lower mounting blocks.

10. The apparatus of claim 1, wherein said profiling tool (7) comprises a plane of symmetry (38) and wherein all components of said profiling tool (7) are mirror-symmetrical to said plane of symmetry.

11. The apparatus of claim 1, wherein said profiling rollers (30) are arranged concentrically around said central longitudinal tool axis (34) so that central planes of said profiling rollers (30) extend substantially radially relative to said tool axis (34), each of said profiling rollers (30) having a half groove (69, 70) along each of its circumferential rim edges so that said half grooves of neighboring profiling rollers (30) contact each other along a respective radially inner plane (61) of said profiling rollers (30).

12. The apparatus of claim 1, further comprising a press having an upper pressure plate (21), and wherein one of said first and second tool sections is operatively connected to said pressure plate (21).

13. The apparatus of claim 3, further comprising a separation plane (38), wherein said mounting blocks forming a pair contact each other along an interface coinciding with said separation plane (38), and wherein each profiling roller (30) comprises a rotation axle (31) having a rotation axis extending in said separation plane (38).

14. The apparatus of claim 3, wherein an upper mounting block (32) of a pair of mounting blocks has an open side facing downwardly, and wherein a lower mounting block (33) of said pair has an open side facing upwardly so that said upper mounting block (32) rests on said lower mounting block (33).

15. The apparatus of claim 13, wherein said separation plane (38) is a plane of symmetry for said profiling tool (7).

16. The apparatus of claim 15, wherein said profiling tool (7) is operatively connected to said pressure plate (21).

* * * * *

UNITED STATES PATENT AND TRADEMARK OFFICE

CERTIFICATE OF CORRECTION

PATENT NO. : 5,862,700

DATED : Jan. 26, 1999

INVENTOR(S) : Erwin Klein

It is certified that error appears in the above-identified patent and that said Letters Patent is hereby corrected as shown below:

Col. 10, line 11, after "claim", replace "15," by --12,--.

Signed and Sealed this

Fifteenth Day of June, 1999

*Attest:*

Q. TODD DICKINSON

*Attesting Officer*

*Acting Commissioner of Patents and Trademarks*